US005883649A

United States Patent [19]

Maeda

[11] Patent Number: 5,883,649

[45] Date of Patent: Mar. 16, 1999

[54] IMAGE FORMING APPARATUS USING AN APERTURE ELECTRODE WITH IMPROVED TONER PASSAGE BY CONTROLLING TONER FLOW TO AND FROM THE APERTURES

[75] Inventor: Masataka Maeda, Konan, Japan

[73] Assignee: Brother Kogyo Kabushiki Kaisha, Nagoya, Japan

[21] Appl. No.: 419,929

[22] Filed: Apr. 11, 1995

[30] Foreign Application Priority Data

May 17, 1994 [JP] Japan ..... 6-103050

[51] Int. Cl.[6] ..... B41J 2/06

[52] U.S. Cl. ..... 347/55; 347/112

[58] Field of Search ..... 347/55, 112, 141, 347/151, 147; 355/261–262

[56] References Cited

U.S. PATENT DOCUMENTS

| | | | |
|---|---|---|---|
| 3,689,935 | 9/1972 | Pressman et al. . | |
| 5,036,341 | 7/1991 | Larsson . | |
| 5,404,155 | 4/1995 | Kitamura | 347/151 |
| 5,448,272 | 9/1995 | Kagayama | 347/55 |
| 5,495,273 | 2/1996 | Kitamura | 347/55 |
| 5,497,175 | 3/1996 | Maeda | 347/55 |

FOREIGN PATENT DOCUMENTS

| | | |
|---|---|---|
| 587 366 | 3/1994 | European Pat. Off. . |
| 1-503221 | 11/1989 | Japan . |
| 5297699 | 11/1993 | Japan . |

OTHER PUBLICATIONS

Patents Abstracts of Japan, SP–7–117262, May 9, 1995.
Patents Abstracts of Japan,JP–7–117265, May 9, 1995.

*Primary Examiner*—Benjamin R. Fuller
*Assistant Examiner*—C. Dickens
*Attorney, Agent, or Firm*—Oliff & Berridge, PLC

[57] ABSTRACT

In an image forming apparatus, a toner carry roller, the upstream surface of an aperture electrode unit and the downstream surface of the aperture electrode unit are processed so that the surface roughness values thereof are equal to about 2 μm, 0.2 μm or less and about 6 μm in terms of Rz, respectively. Accordingly, at the upstream side of the toner supply direction, the friction coefficient between the toner and the upstream surface is smaller than that between the toner and the toner carry roller surface so that subsequently-supplied toner pushes previously-supplied toner to the apertures of the aperture electrode unit. At the downstream side of the toner supply direction, the friction coefficient between the toner and the toner carry member is smaller than that between the toner and the downstream surface, the toner which is carried and supplied by the toner carry roller is fed to the apertures where it is dammed up by the toner adhering to the downstream surface. The toner fed to the apertures is electrostatically attracted to a supporter side by control electric field and then flies onto the supporter, thereby forming picture elements.

15 Claims, 4 Drawing Sheets

IMAGE FORMING APPARATUS USING AN APERTURE ELECTRODE WITH IMPROVED TONER PASSAGE BY CONTROLLING TONER FLOW TO AND FROM THE APERTURES

BACKGROUND OF THE INVENTION

1. Field of the Invention

The invention relates to an image forming apparatus which is suitably usable for a copying machine, a printer, a plotter, a facsimile or similar printing apparatus.

2. Description of Related Art

A conventionally known image forming apparatus is disclosed in U.S. Pat. No. 3,689,935. The apparatus uses an electrode having plural opening portions (hereinafter referred to as "apertures") and a voltage is applied to the electrode in accordance with image data to control passage of toner particles through the apertures, whereby an image is formed on a supporter (image receiving medium) with the passed toner particles.

The image forming apparatus includes an aperture electrode unit comprising an insulating flat plate, a reference electrode formed continuously on one surface of the flat plate, plural control electrodes which are formed on the other surface of the flat plate and are electrically insulated from one another and at least one row of apertures, an aperture formed in correspondence with each control electrode so as to penetrate through the flat plate, the reference electrode and the corresponding control electrode; means for selectively applying a voltage across the reference electrode and the control electrodes; means for supplying charged toner particles so that the flow of the toner particles passed through the apertures is modulated in accordance with the applied voltage; and means for moving a supporter and the aperture electrode unit relative to one another to position the supporter in a particle flow passage.

However, in this apparatus, recording quality is liable to be degraded due to clogging of the apertures with toner particles and the recording speed cannot be set to a high value.

European Unexamined Patent Publication No. 587,366 discloses an image recording apparatus which is capable of improving the recording characteristic by disposing a carry member for holding toner and an aperture electrode unit so that these members are brought into contact with each other. According to this apparatus, the toner is supplied to the aperture electrode unit while brought into contact with the peripheral portions of apertures of the aperture electrode unit so that there is no toner deposition which will cause the clogging of the apertures with the toner. Thus, the apertures are prevented from being clogged.

However, in the conventional image forming apparatus as described above, a high driving voltage is required to force the toner to be separated from a carry member and to fly toward a supporter (image receptor) side because the toner is supplied onto the carry member while adhering to the carry member due to image force, van der Waals force, etc. The result is the total manufacturing cost of the apparatus containing a driving element is high.

SUMMARY OF THE INVENTION

An object of the invention is to provide an image forming apparatus which can form a high-quality image with a low driving voltage and at a low price.

In order to attain the above object, according to the invention, an image forming apparatus comprising toner carrying means for supplying charged toner particles, the toner carrying means having a friction coefficient with the toner particles; a back electrode; toner flow control means provided between the toner carrying means and the back electrode, the toner flow control means having a toner flow control portion for controlling a flow of the charged toner particles supplied by the toner carrying means through the toner flow control means and for forming an image on a recording medium disposed between the toner flow control means and the back electrode, the toner flow control means including an upstream portion in a toner feeding direction and a down stream portion in the toner feeding direction, the upstream portion having a lower friction coefficient with the toner particles than that of the toner carrying means and the downstream portion having a higher friction coefficient with the toner particles than that of the toner carrying means.

According to the image forming apparatus of the invention thus structured, the toner particles are carried on the toner carrying means and fed to the toner flow control means. In this case, at the upstream side of the toner supply direction, the friction coefficient between the toner and the upstream surface is set to be smaller than that between the toner and the toner carrying means so that previously-supplied toner slips toward the toner flow control portion along the upstream surface while being pushed by subsequently-supplied toner.

At the downstream side of the toner supply direction, the friction coefficient between the toner and the toner carrying means is set to be smaller than that between the toner and the downstream surface so that the toner fed to the downstream surface is trapped on the downstream surface even when pushed by the toner carried on the toner carrying means and the toner carried on the toner carry member slips along the surface of the toner carrying means. Accordingly, the toner carried on the toner carrying means is fed to the toner flow control portion while dammed up by the toner adhering to the downstream surface. The toner supplied to the toner flow control portion is electrostatically drawn from the toner flow control portion to the recording medium side by a control electric field produced at the toner flow control portion, and further electrostatically attracted onto the recording medium by a back electric field, thereby forming an image on the recording medium.

If the upstream surface, the surface of the toner carrying means and the downstream surface are designed to have larger surface roughness values in this order, the friction coefficient between the toner and each of these surfaces can be varied in accordance with the variation of the surface roughness of each surface.

As is apparent from the foregoing, according to the image forming apparatus of the invention, a larger amount of toner can be supplied beneath the toner control portion for forming an image by the push of the toner from the upstream surface and the dam-up of the toner on the downstream surface, so that the contrast of an image formed can be improved. As a result, the driving voltage can be reduced and a low-price driving element can be used. Therefore, an image forming apparatus which is capable of forming a high-quality image can be provided at a low price.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

Figure 1:
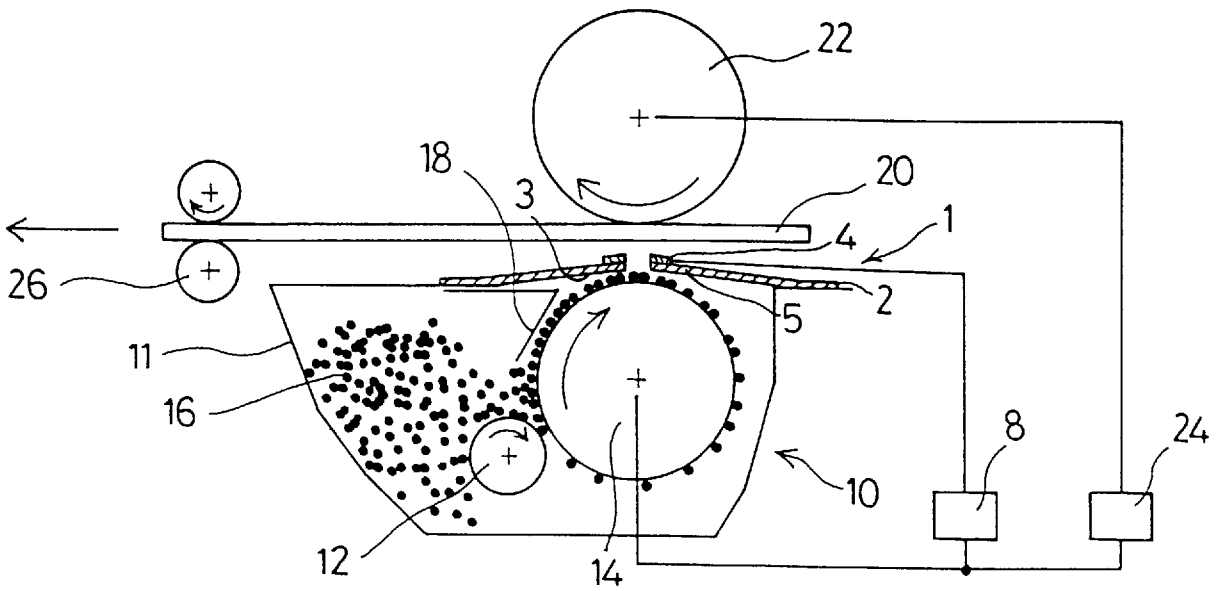
FIG. 1 is a cross-sectional view showing the structure of an image forming apparatus according to an embodiment of the invention.

A preferred embodiment according to the invention will be described with reference to the accompanying drawings. FIG. 1 shows schematically the structure of an image forming apparatus of an embodiment according to the invention. As shown in FIG. 1, a cylindrical counter electrode roller 22, serving as a counter electrode, is rotatably supported at the upper side of an aperture electrode unit 1 by a chassis (not shown) so as to be spaced away from an aperture electrode unit 1 at an interval of 0.5 mm. A supporter (image receptor) is inserted into the gap between the aperture electrode unit 1 and the counter electrode roller 22 and fed therethrough. A toner supply device 10 is disposed along the longitudinal direction of the aperture electrode unit 1 at the lower side of the aperture electrode unit 1. Further, a fixing device 26 is disposed at the downstream side of the feeding direction of the supporter 20 which is fed by the counter electrode roller 22.

The toner supply device 10 comprises a toner case 11 which is also used as a housing of the image forming apparatus, toner 16 stocked in the toner case 11, a toner supply roller 12, a toner carry roller 14 serving as a toner carry member, and a toner-layer restricting blade 18 serving as toner-layer restricting means. The toner carry roller 14 is formed of an aluminum roller which is subjected to a sand blasting treatment on the surface thereof. The toner carry roller 14 carries the toner 16 thereon to feed the toner 16 toward the aperture electrode unit 1. The surface roughness of the surface of the toner carry roller 14 is set to about 2 $\mu$m in terms of Rz. The toner supply roller 12 serves to supply the toner 16 to the toner carry roller 14.

The toner supply roller 12 and the toner carry roller 14 are supported by the toner case 11 so as to rotate in the directions indicated by arrows in FIG. 1. The rollers 12,14 are disposed in parallel to and in contact with each other. The toner-layer restricting blade 18 serves to adjust the amount of the toner 16 so that the amount of the toner 16 on the toner carry roller 14 is uniform over the surface of the roller and also serves to uniformly charge the toner 16. Therefore, the toner-layer restricting blade 18 is pressed against the toner carry roller 14.

Figure 2:
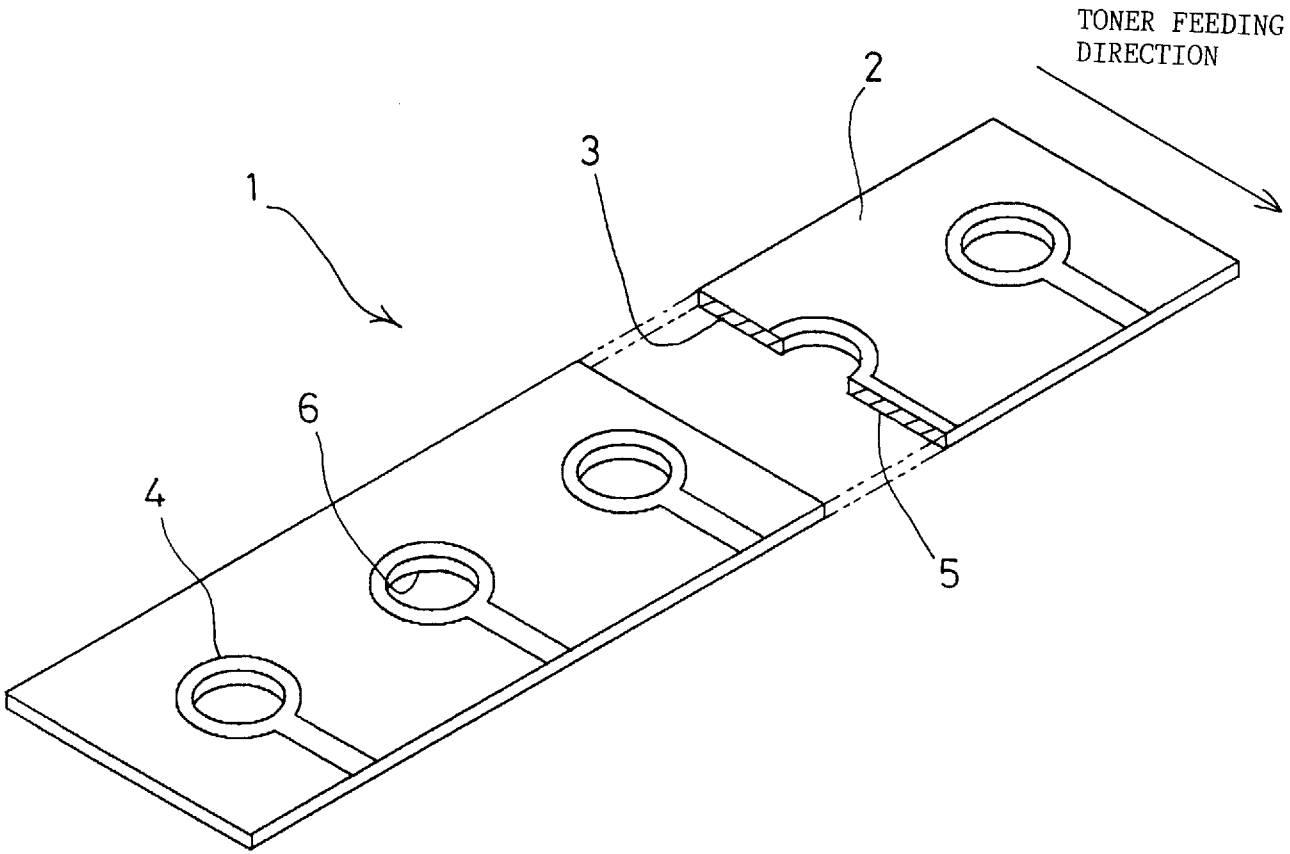
FIG. 2 is a perspective view showing an aperture electrode unit used in the image forming apparatus of the embodiment.
Figure 3:
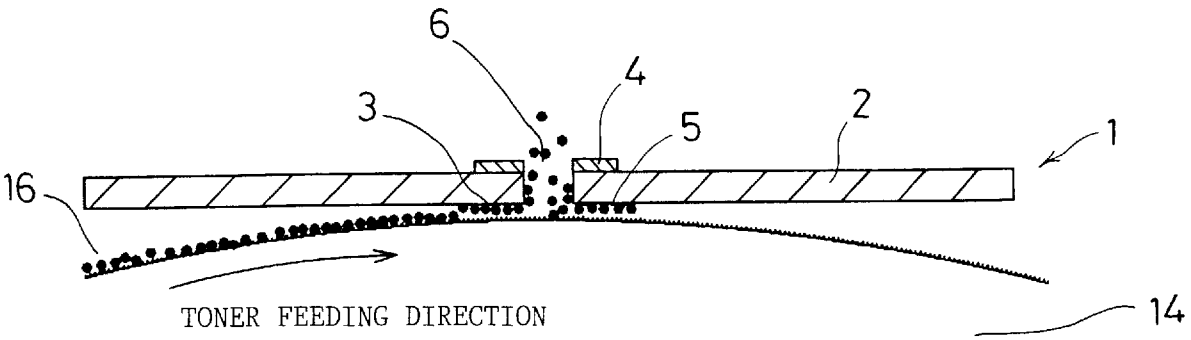
FIG. 3 is an enlarged view showing the vicinity of a control electrode corresponding to an image portion.
Figure 4:
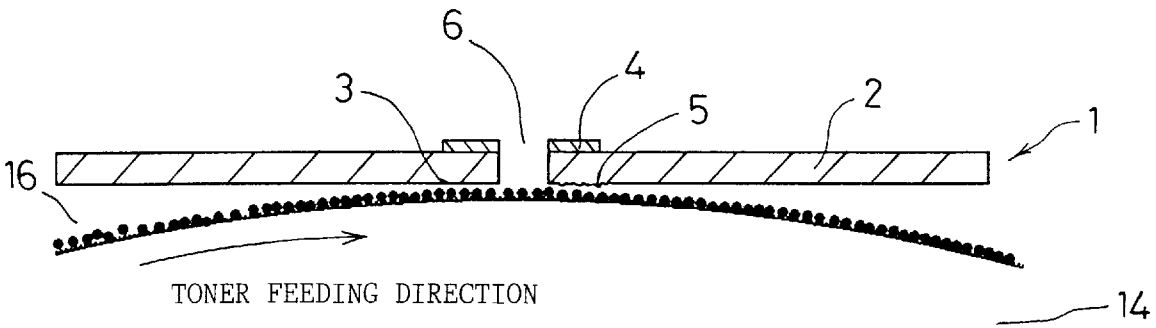
FIG. 4 is an enlarged view showing the vicinity of a control electrode corresponding to a non-image portion.

As shown in FIG. 2, the aperture electrode unit 1 comprises an insulation sheet 2 of polyimide having a thickness of 25 $\mu$ in which a plurality of apertures 6, each having a diameter of 100 $\mu$m, are aligned in a row. The control electrodes 4 each have a 1 $\mu$m thickness and are formed on the insulation sheet 2 so that a control electrode 4 surrounds each aperture 6. The apertures 6 and the control electrodes 4 constitute a toner flow control portion.

As shown in FIG. 1, the aperture electrode unit 1 is disposed so that the control electrodes 4 face the supporter 20 and the aperture electrode unit 1 is in the vicinity of the toner carry roller 14 at the aperture position. The gap interval between the aperture electrode unit 1 and the toner carry roller 14 is preferably in the range from the distance equal to the toner particle diameter to the double distance of the toner particle diameter, and it is more preferably set to about 1.5 times the toner particle diameter.

In the following description, an upstream surface 3 is defined as a part of one surface (lower surface in FIG. 1) of the aperture electrode unit 1 which faces the toner carry roller 14 and is disposed at the upstream side of the toner feed direction (from the left to the right in FIG. 1), and a downstream surface 5 is defined as the other part of the one surface of the aperture electrode unit 1 which faces the toner carry roller 14 and is disposed at the downstream side of the toner feed direction. In this case, the upstream and downstream surfaces 3 and 5 are subjected to a sand blasting treatment so that the surface roughness of the upstream surface 3 of the aperture electrode unit 1 is equal to 0.2 $\mu$m or less in terms of Rz, and the surface roughness of the downstream surface 5 is equal to about 6 $\mu$m in terms of Rz.

Further, a control voltage applying circuit 8 serving as control voltage applying means is connected between the control electrodes 4 and the toner carry roller 14. The control voltage applying circuit 8 serves to apply a voltage of −20 V or +40 V to the control electrodes 4 on the basis of an image signal. A DC power source 24 is connected between the counter electrode roller 22 and the toner carry roller 14 and the counter electrode roller 22 is supplied with a voltage of +1 kV by the DC power source.

The operation of the image forming apparatus thus structured will be described. First, upon rotation of the toner carry roller 14 and the supply roller 12, in the directions as indicated by the arrows in FIG. 1, the toner 16 which is fed from the supply roller 12 is rubbed against the toner carry roller 14 to be negatively charged and carried on the toner carry roller 14. The toner 16 carried on the toner carry roller 14 is thinned and further charged by the toner-layer restricting blade 18 and then fed toward the aperture electrode unit 1 by rotation of the toner carry roller 14.

At this time, the control electrodes 4, corresponding to an image portion, are supplied with a voltage of +40 V from the control voltage applying circuit 8, so that electric lines of force are produced in the vicinity of the apertures 6 corresponding to the image portion due to the potential difference between the control electrodes 4 and the toner carry roller 14. As a result, the toner 16, which is negatively charged on the toner carry roller, passes through the apertures 6 and is attracted to the upstream surface 3 and the downstream surface 5. In this case, since the surface roughness of the upstream surface 3 is set to be smaller than that of the toner carry roller 14 at the upstream side of the toner feed direction, the friction coefficient between the toner and the upstream surface 3 is smaller than the friction coefficient between the toner and the toner carry roller 14 at the upstream side of the toner feed direction. Therefore, the toner is fed through the action as described below.

When the toner 16 on the toner carry roller 14 is further fed to the aperture electrode unit 1 in a state where the toner 16 is attracted to the upstream surface 3 of the aperture electrode unit 1, the toner 16 which is attracted to the upstream surface 3 of the aperture electrode unit 1 is pushed toward the apertures 6, with slipping along the upstream surface 3, by the toner on the toner carry roller 14.

Furthermore, the surface roughness of the toner carry roller 14 is smaller than that of the downstream surface 5 of the aperture electrode unit 1 at the downstream side of the toner feed direction. Thus, the friction coefficient between the toner 16 and the toner carry roller 14 is smaller than that between the toner 16 and the downstream surface 5. Therefore, even when the toner 16 which is attracted to the downstream surface 5 is pushed by the toner 16 carried on the toner carry roller 14, it is prevented from falling from the downstream surface 5 and being carried away by the toner carry roller 14. Thus, the toner 16 is trapped on the downstream surface 5. On the other hand, the toner 16 which is carried on the toner carry roller 14 is dammed up by the toner 16 trapped on the downstream surface 5 and slips along the surface of the toner carry roller 14. Accordingly, the toner 16 which continues to be fed by the toner carry roller 14 is dammed up by the toner 16 adhering to the downstream surface 5 and becomes trapped beneath the apertures 6. The toner trapped beneath the apertures 6 is electrostatically attracted to the supporter 20 by the electric field produced by the control electrodes 4 and is further attracted and deposited onto the supporter 20 by the electric field produced by the counter electrode roller 22 to thereby form picture elements corresponding to the apertures.

On the other hand, the control electrodes 4 corresponding to a non-image portion are supplied with a voltage of −20 V from the control voltage applying circuit 8. As a result, electric lines of force directed from the toner carry roller 14 to the control electrodes is formed and the negatively charged toner on the toner carry roller 14 is electrostatically attracted to the toner carry roller 14. Therefore, the toner 16 on the toner carry roller 14 is passed along the lower side of the apertures 6 while carried on the toner carry roller 14. Thus, it is not passed through the apertures 6 so that no picture element is formed on the supporter.

Further, the supporter 20 is fed in a direction perpendicular to the aperture array by the distance corresponding to one picture element while a picture-element array of toner 16 is formed on a line on the surface of the supporter 20, and a toner image is formed on the whole surface of the supporter 20 by repeating the above process. Thereafter, the formed toner image is fixed onto the supporter 20 by the fixing device 26.

The invention is not limited to the above embodiment, and various modifications may be made without departing from the subject matter of the invention.

For example, in the above embodiment, the friction coefficient between the toner 16 and each of the upstream surface 3, the downstream surface 5 and the toner carry roller 14 surface is varied by changing the surface roughness of each surface. However, the friction coefficient between the toner and each of the surfaces may be varied using a solid lubricant coating. Molybdenum disulfide; graphite; boron nitride; a fluorocarbon resin, such as PTFE; and PbO may be used as a solid lubricant for the solid lubricant coating. The solid lubricant coating may be used for the upstream surface 3, the downstream surface 5 and the toner carry roller 14 surface, however, it is preferably used for the upstream surface 3 or the toner carry roller 14 surface which has low friction coefficient.

Further, in the above embodiment, the aperture electrode unit is used as the toner flow control means, however, a mesh-shaped electrode unit as disclosed in U.S. Pat, No. 5,036,341 or an edge electrode as disclosed in a copending U.S. application Ser. No. 08/205,827 may be used.

What is claimed is:

1. An image forming apparatus using charged toner particles, comprising:

toner carrying means having a direction of rotation for feeding the charged toner particles in the direction of rotation, said toner carrying means having a surface roughness that produces a coefficient of friction with the charged toner particles;

a back electrode;

toner flow control means for passing the charged toner particles provided between said toner carrying means and said back electrode, said toner flow control means comprises:

a toner flow control portion for controlling a flow of the charged toner particles supplied by said toner carrying means through said toner flow control means and for forming an image on a recording medium disposed between said toner flow control means and said back electrode;

an upstream portion of the toner flow control means upstream with respect to the direction of rotation, said upstream portion having a lower coefficient of friction with the charged toner particles than that of said toner carrying means; and a downstream portion of the toner flow control means downstream with respect to the direction of rotation, the downstream portion having a higher coefficient of friction with the charged toner particles than that of said toner carrying means.

2. The image forming apparatus as claimed in claim 1, wherein the upstream portion has a surface roughness that is smaller than that of said toner carrying means and the downstream portion has a surface roughness that is higher than that of said toner carrying means.

3. The image forming apparatus as claimed in claim 1, wherein said toner flow control means is separated from said toner carrying means so as to have toner particles therebetween.

4. The image forming apparatus as claimed in claim 1, wherein said coefficient of friction of said toner carrying means is about 2.0 $\mu$m in terms of Rz, said lower coefficient of friction is less than or equal to 0.2 $\mu$m in terms of Rz, and said higher coefficient of friction is about 6 $\mu$m in terms of Rz.

5. An image forming apparatus, using charged toner comprising:

toner supply means for supplying the charged toner;

an aperture electrode unit opposing said toner supply means;

a counter electrode opposing said aperture electrode unit on a side opposite said toner supply means; and a print medium feed means for feeding a print medium through a print position between said aperture electrode unit and said counter electrode, wherein said toner supply means comprises a toner carry roller having a peripheral surface with a first coefficient of friction and that rotates in a direction of rotation and said aperture electrode unit has:

a plurality of apertures aligned to define an axis transverse to a feed direction of the print medium;

an upstream surface, upstream with respect to said axis of said aperture electrode unit in the direction of rotation of the toner carry roller and facing the toner carry roller, has a second coefficient of friction, and a downstream surface, downstream with respect to said axis of said aperture electrode unit in the direction of rotation of the toner carry roller and facing the toner carry roller, has a third coefficient of friction, wherein the first coefficient of friction, the second coefficient of friction, and the third coefficient of friction all have different values.

6. The image forming apparatus as claimed in claim 5, wherein said peripheral surface, said upstream surface and said downstream surface are each roughened to provide said first coefficient of friction, said second coefficient of friction and said third coefficient of friction, respectively.

7. The image forming apparatus as claimed in claim 5, wherein said second coefficient of friction is less than said first coefficient of friction, and said first coefficient of friction is less than said third coefficient of friction.

8. The image forming apparatus as claimed in claim 6, wherein said second coefficient of friction is less than said first coefficient of friction, and said first coefficient of friction is less than said third coefficient of friction.

9. The image forming apparatus as claimed in claim 5, wherein said aperture electrode unit is separated from said toner carry roller by a distance range of one toner particle diameter to two toner particle diameters.

10. The image forming apparatus as claimed in claim 9, wherein the separation distance is equal to 1.5 particle diameters.

11. The image forming apparatus as claimed in claim 5, wherein said first coefficient of friction is about 2.0 $\mu$m in terms of Rz, said second coefficient of friction is less than or equal to 0.2 $\mu$m in terms of Rz, and said third coefficient of friction is about 6 $\mu$m in terms of Rz.

12. The image forming apparatus as claimed in claim 6, wherein a coating may be applied to at least one of said peripheral, upstream and downstream surfaces to provide a coefficient of friction.

13. The image forming apparatus as claimed in claim 12, wherein said coating is applied to either of said peripheral surface and said upstream surfaces.

14. The image forming apparatus as claimed in claim 12, wherein a coating is applied to both of said peripheral surface and said upstream surface.

15. The image forming apparatus as claimed in claim 12, wherein the coating is selected from the group consisting of molybdenum disulphide, graphite, boron nitride, a fluorocarbon resin, and PbO.

* * * * *